US005202093A

United States Patent [19]

Cloyd

[11] Patent Number: 5,202,093

[45] Date of Patent: Apr. 13, 1993

[54] SEALING CAP WITH A ONE WAY VALVE HAVING SEMI-CYLINDRICAL VALVE CLOSURE SPRINGS

[75] Inventor: Willliam C. Cloyd, Lexington, Ky.

[73] Assignee: Medical Robotics, Inc., Lexington, Ky.

[21] Appl. No.: 703,153

[22] Filed: May 20, 1991

[51] Int. Cl.[5] ..... B01L 3/14

[52] U.S. Cl. ..... 422/102; 422/103; 435/296; 215/247; 215/249; 215/311; 215/315

[58] Field of Search ..... 422/102, 103, 100; 435/296; 73/864.86; 215/247, 249, 311, 315, 354, 355; 222/494

[56] References Cited

U.S. PATENT DOCUMENTS

| | | | |
|---|---|---|---|
| 1,509,916 | 9/1924 | Waite | 215/247 |
| 1,738,080 | 12/1929 | Smith | 222/494 |
| 2,579,724 | 12/1951 | Breakstone | 215/247 |
| 2,906,423 | 9/1959 | Sandhage | 215/249 |
| 3,084,823 | 4/1963 | Reichstein | 215/311 |
| 4,134,512 | 1/1974 | Nugent | 215/247 |
| 4,152,269 | 5/1979 | Babson | 215/247 |
| 4,763,803 | 8/1988 | Schneidr | 215/311 |
| 4,954,149 | 9/1990 | Fullemann | 215/247 |

FOREIGN PATENT DOCUMENTS 8301912 6/1983 World Int. Prop. O. .

*Primary Examiner*—James C. Housel
*Assistant Examiner*—Jan M. Ludlow
*Attorney, Agent, or Firm*—Vance A. Smith

[57] ABSTRACT

A cap for a container having a slit seal and semi-cylindrical spring seal closure members that abut the inner container wall and contact the slit seal at two points spaced from the center of the slit seal. The spring members permit the flexure of the seal into the space defined by the spring when an instrument penetrates the seal. In further embodiments, the cap has a secondary closure and can maintain vacuum in a container.

9 Claims, 2 Drawing Sheets

SEALING CAP WITH A ONE WAY VALVE HAVING SEMI-CYLINDRICAL VALVE CLOSURE SPRINGS

BACKGROUND OF THE INVENTION

This invention relates to a cap for sealing containers containing liquid samples such as blood and, more specifically, pertains to a stopper having an opening biased by a spring element into a closed position which opening is adapted to receive a pipette for aspirating the samples of the liquid.

The use of stoppers which are penetrable by a sharp instrument such as a needle for removal of the contents of the container have been in use for years. An early example of a stopper capable of being penetrated is found in U.S. Pat. No. 1,616,274 issued on Feb. 1, 1927 to Mulford.

More recently, however, it has become common place to use stoppers which accommodate more blunt instruments for removal of samples of the liquid for investigation and analysis. For example, it has become extremely well known that the multitude of biological samples, particularly blood and blood serums, awaiting analysis must be in closed containers to avoid the hazards of exposing medical personnel and the potential of degrading the sample through evaporation. The primary reason for desiring easy access to the container is to allow either the manual aspiration of the liquid with a pipette or the like or automated aliquoting of the sample by the testing apparatus. Such sampling techniques are carried out with disposable plastic pipettes or delicate instrument probes, neither of which is capable of piercing a rubber septum.

While the prior art is replete with examples of penetrable stoppers or caps sealing containers storing fluid for analysis, the problem was and still is to ensure that nothing contaminates the fluid sealed in the container before analysis and that the fluid itself does not escape or otherwise leak from the container either before or after sampling. Typical prior art caps involve the use of a body that fits within the cavity of a sample container and is provided with a closable opening or slit for entry of blunt, but narrow, hollow cylindrical object such as a pipette for removing a portion of the liquid contained therein. The body is made from a resilient material which is stretched by the insertion of the pipette into the slit. The slit closes due to the natural bias of the material after the pipette is removed, thus in effect forming a one-way type of valve arrangement.

An example of such a cap for this purpose is shown in U.S. Pat. No. 4,515,752 issued May 7, 1985 to Miramanda. The cavity of the cap is closed by resilient body having a plurality of pie-shaped segments which when pressed together form a plurality of closed slits. The slits are maintained closed by the compression of the cap within the container. When a pipette is pushed against the segments, they part and then come together again after the pipette is withdrawn due to the resiliency of the material forming the segments.

The major drawbacks with prior art type of caps involving one way type of valves are complexity and cost. Once used, the caps, of necessity, are thrown away or at least recycled. Thus, simplicity of construction to maintain low costs is of paramount consideration. Additionally, the caps must be of sound construction and perform well despite the low cost. Specifically, it is desirable that the cap be easily accessible to blunt ended instruments such as pipette for aspiration of the sample housed within the container and provided with a positive feature for maintaining the opening in the cap closed other than through the natural resiliency of the material used in its construction. It is further desirable that the opening be biased closed with such a positive feature along a substantial portion of its length to prevent inadvertent opening to occur even when urged closed at its midpoint.

SUMMARY OF THE INVENTION

A cap in accordance with the present invention is provided for a container and comprises an annular outer flange adapted to grip an outer surface of said container and an annular top wall from which a centrally disposed boss member descends. The boss member defines a cavity open at the end adjacent said top wall. The boss member further has an outer surface adapted to provide a liquid tight seal against the inner surface of the container and converging walls which define a closed slit at the lower end of the cap. Flexible spring elements are also attached to said boss member for contacting the inner walls of said container when said cap is placed thereupon and for providing slit-closing biasing forces in directions substantially normal to the direction of said slit and spaced apart from the midpoint of the slit.

BRIEF DESCRIPTION OF THE DRAWING

The accompanying drawing incorporated in and forming a part of the specification, illustrates several aspects of the present invention, and together with the description serves to explain the principles of the invention.

In the drawing.

DETAILED DESCRIPTION OF THE PREFERRED EMBODIMENTS

Figure 1:
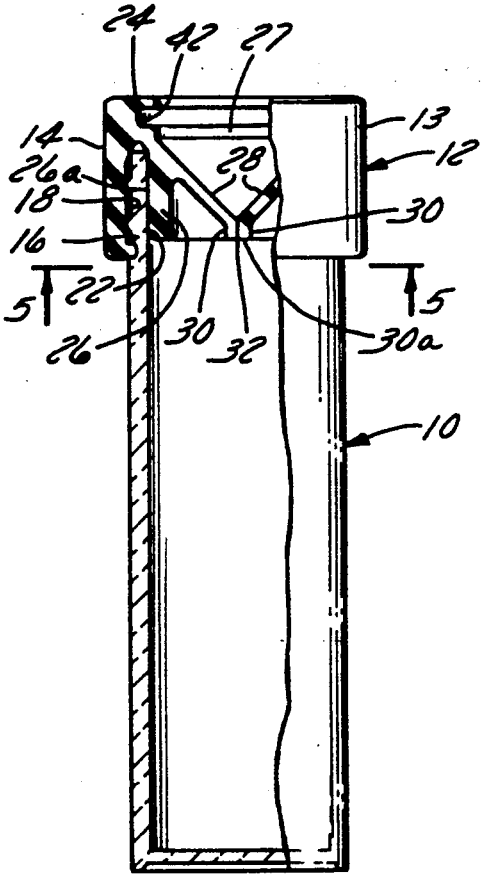
FIG. 1 is a side view, mostly in section, of a cap in accordance with the present invention positioned on top of a container.

Reference is now made to FIG. 1 in which a container 10 is shown sealed by a cap shown generally by the character numeral 12. A portion of the cap 12 is depicted without sectioning to demonstrate its outer gripping surface 13 and partially in section to demonstrate an outer annular flange 14 having an inner surface 18 adapted to grip the outer surface 16 of container 10. Inner surface 18 made be provided with a series of grooves to facilitate gripping action by cap 12 when used with threaded containers.

Figure 2:
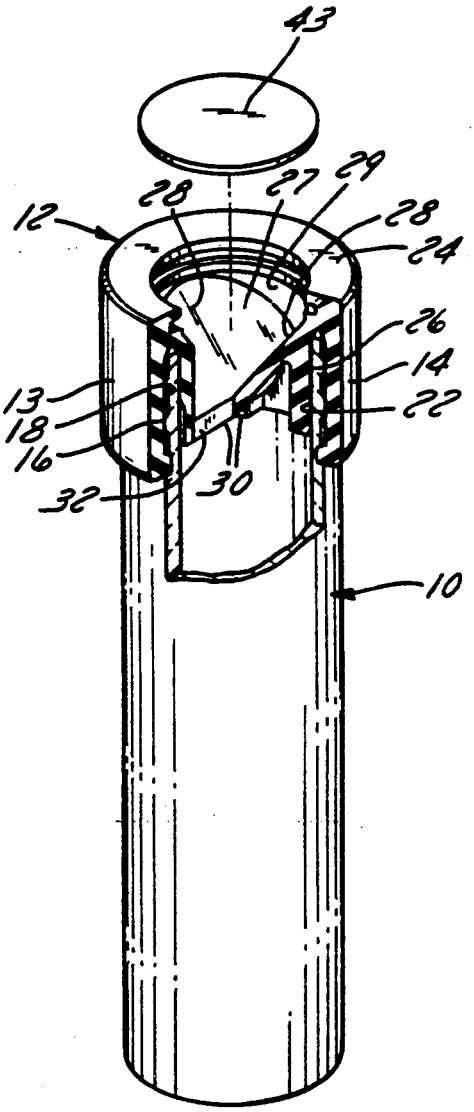
FIG. 2 is a perspective view of a cap constructed in accordance with the present invention with a portion of the outer flange and container broken away to demonstrate the inner geometry of the cap.
Figure 3:
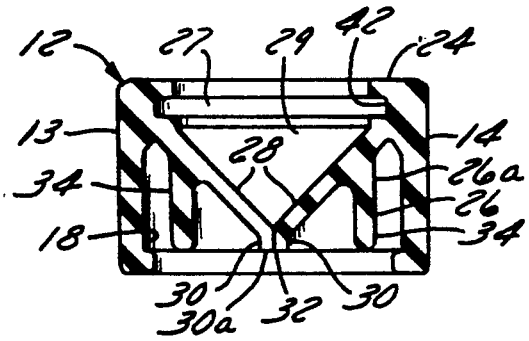
FIG. 3 is a view in side section of the cap taken along lines 3—3 of FIG. 6.
Figure 4:
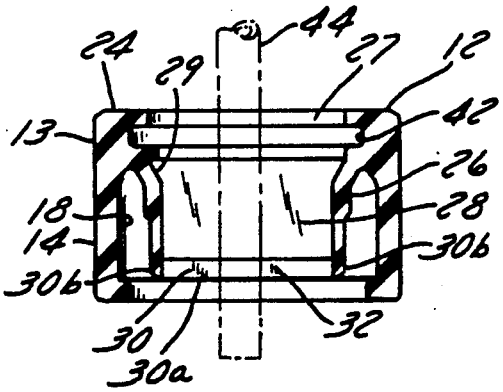
FIG. 4 is a view in side section of the cap taken along lines 4—4 of FIG. 6.

As perhaps best seen in FIGS. 2, 3 and 4, cap 12 is provided with an annular top wall 24 from which both flange 14 and a centrally disposed, substantially annular boss 26 descend. Boss 26 defines a central cavity 27 adapted to receive a pipette or other object designed to aspirate or otherwise remove a sample of the liquid stored in the container 10. The outer surface 26a of boss 26 is adapted to abut and grip the inner surface 22 of the container 10 in a liquid tight manner. A pair of converging inclined walls or leaves 28 joined together by side walls 29 are integral with and descend from the bottom of boss 26. Near the point of convergence, leaves 28 are truncated to form or otherwise are integral with a pair of lips 30 separated in part by a slit opening 32. Lips 30 may be provided with a substantially rectangular cross-section as shown with a flat bottom surface 30a and end walls 30b (best seen in FIG. 5). End walls 30b are an extension of side walls 29.

Figure 5:
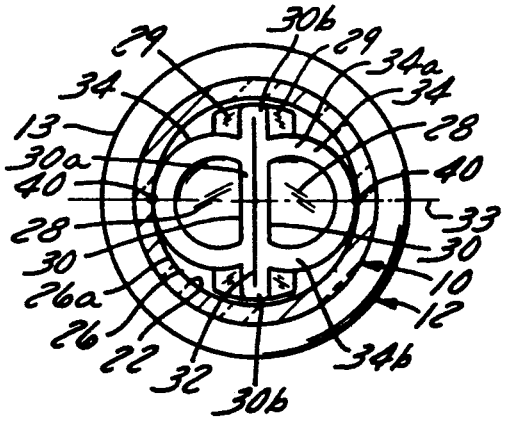
FIG. 5 is a bottom sectional view taken along lines 5—5 of FIG. 1.
Figure 7:
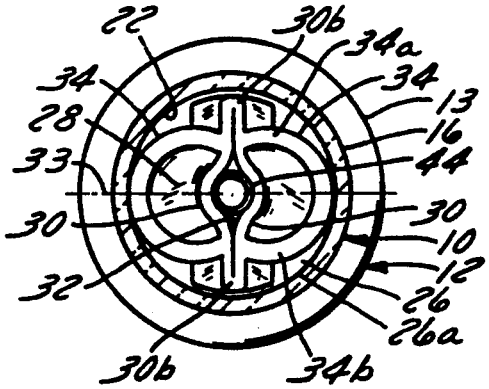
FIG. 7 is a bottom sectional view of the cap of FIG. 5 with a pipette inserted through the slit.

Referring now to FIGS. 2 and 5, a pair of hollow, spring elements 34, which preferably have a substantially circular cross-section, also descend from the bottom of boss 26. The thin cylinder walls of each spring element 34 form a pair of lines of intersection with respective leaves 28. The intersection is perhaps best seen in the sectioned part of FIG. 2. The lines of intersection are about equidistant from a plane normal to the direction of the slit opening 32 and through the midpoint thereof. This geometric arrangement provides for pair of "legs" 34a and 34b for each element 34 for a purpose to be described below. As best seen in FIGS. 1, 2, 5 and 7, the hollow spring elements 34 can be considered segments of a hollow cylinder having a longitudinal axis which is substantially parallel to the axis of a container when the boss 26 is forced into the mouth of the container. Each segment has terminal surfaces which abut leaves 28. The arcuate portion of the segment forms with leave 28 a cavity which is positioned both near the slit opening 32 and about the plane passing through the midpoint thereof. The arcuate portion abuts the container wall as shown when the boss 26 is placed in the mouth of a container.

As seen in FIG. 4, the mouth of each element 34 formed by the terminus ends thereof and the flat surface 30a of the lips 30 are essentially co-planar and do not extend downwardly as far as the outer flange 14. Additionally, the length of the lips 30 is less than the total distance across both of the elements 34 and the width of lips 32. In other words, lip edge walls 30b would lie inside a circle drawn tangent to elements 34 at point of tangency noted by points 40 seen in FIG. 5. Again the purpose of this relationship will be discussed in the operation as set forth below.

The cap in accordance with the present invention may be fabricated from any material having elastomeric characteristics and compatible with the material contained by the container. Examples of such material are silicone and other compositions marketed under the names Santoprene and Kraton, the respective trademarks of the Monsanto Corporation and the Shell Corporation. The manufacturing process for making such caps is not important to the invention although it has been found that use of those materials best suited for an injection molding of the material appears to be the most practical way of producing a quality cap in quantities needed.

Another advantageous feature of the present invention is the provision of an annular groove 42 about the inner circumference of cavity 27 near the top thereof as best seen in FIG. 2. The annular groove 42 permits the press fit insertion of a removable secondary stopper 43 for further safe guard against the leakage of the liquid within container 10 under more extraordinary circumstances. Use of the secondary stopper 43 would be appropriate when the container is to be transmitted over long distances and may be subjected to rough handling or vibrations. Secondary stopper may be provided with a tab (not shown) for easy removal.

Additionally, the secondary stopper provides the ability for the container 10 to function as a vacuum container prior to the storage of a liquid sample. This allows the container 10 to used for a variety of important purposes. For example, the stopper 43 could be fabricated from a penetrable material such as rubber and act as a rubber septum for the entry of the liquid sample by a sterilized hypodermic needle. The needle passing through secondary stopper 43 then penetrates slit 32 and the liquid under vacuum is stored in the container 10. The container 10 could then be moved for further processing such as for centrifuging in the case of blood or blood serum. Following this further processing, the secondary stopper 43 could be removed to allow aspiration of the liquid by a pipette or the like.

Reference is now made to FIG. 2 which depicts a cap in accordance with the present invention positioned on a container 10. As may be seen the inner flange surface of boss 26 abuts the inner surface 18 of the container 10 in a liquid tight manner. The spring elements 34 also abut the inner surface 18. Opposing forces from each spring element 34 are set up which act along the "legs" 34a and 34b of each spring element 34 in a direction substantial normal to the alignment of the slit 32. Because the "legs" 34a and 34b are separated and spaced about the "midpoint line" of the slit 30, i.e., a line drawn normal to the alignment and through the midpoint of the slit 32 as shown by dashed line 33 in FIGS. 5 and 7, the slit 32 is evenly biased to a closed position along substantially its entire length.

Providing spaced biasing forces in the manner described is a distinct advantage over the use of a stoppers in which the biasing force is directed only at the midpoint of a slit opening. Additionally, the spacing of the "legs" 34a and 34b allows for easier insertion of the pipette since the biasing forces are not directed or focused at the mid point of the slit 32 where a pipette is normally inserted.

Where the manufacture of a stopper made in accordance with the present invention is accomplished through a one step, injection molding process, the slit may be "molded in" rather than cut after molding. Any tendency for the slit to remain open after manufacture will be overcome since the walls of the spring elements 34 abut the inner side wall of the container 10 when the cap 12 is placed on the container 10. Such abutment provides for the positive closing of the slit 32.

As mentioned above, the distance between the side walls 29 (and thus end walls 30b of the lips 30) is less than the total distance across the elements 34. Thus, when the cap 12 of the present invention is placed over the mouth of a container 10, the side walls 29 are separated from the inner surface of the container 10. This prevents preloading forces along the slit 32. In other words, the separation prevents the inner container wall from compressing the lips 30 when the caps 12 is first pressed down and placed over the mouth of the container 10. Otherwise forces would be being generated along the slit 32 which would tend to cause the lips 30 to bend outwardly and therefore opening slit 32.

Figure 6:
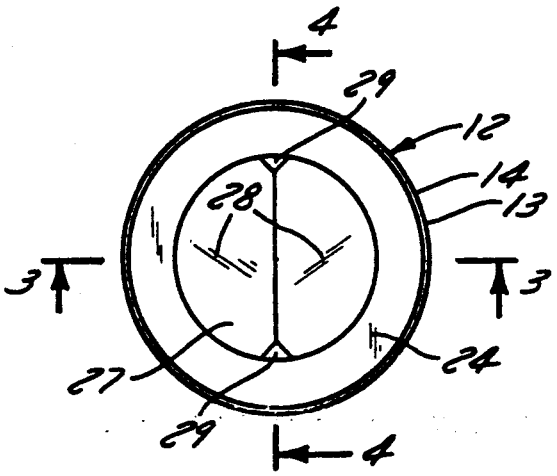
FIG. 6 is a top view of the cap of FIG. 1.

To withdraw a sample from the container 10, the handler inserts a pipette 44 (as shown in FIG. 6) into the cavity 27 whereupon the end of the pipette 44 is guided by the convergence of the leaves 28 toward the slit 30. Pipette 44 is then forced through against the spaced biasing forces of the spring elements 34. Since the forces are spaced about the midpoint, instead of being focused at the mid point such as with the use of a solid resilient element, the end of the pipette 44 slides easily through the slit 32 and the lips 30 partially fold around the pipette 44 as shown. Upon completion of the aspiration of the liquid sample, the pipette 44 is withdrawn and the lips 30 seal tight again along the entire length of slit 32 due to the bias forces exerted by elements 34.

Thus, from the above, it will be recognized that the inventive features as described attain the advantages previously mentioned as desirable and needed. For example, the cap of the present invention provides for a positive closing of the slit after the sample has been removed. Moreover, the positive closing is evenly spread over the length of the slit as opposed to the closing forces merely being focused at the midpoint of the slit. Additionally preloading of forces along the length of the slit is eliminated, avoiding the bending of the lips outwardly which tends to cause premature or unwanted opening of the slit. Finally, provision is made for a supplemental seal as an additional precaution to accommodate unusual handling such as that which may be experienced in long distance freighting of the containers.

Other advantages, modifications, and applications will become clear to those skilled in the art of designing caps for sealing sample containers from a reading of the attached description and drawing without departing from the spirit of the claims. For example, a container having a stopper constructed in accordance with the present invention may be used to hold solid material in which a liquid or other solid material is to be added with a blunt instrument such as a pipette.

It should also be clear that other configurations of the spring elements, such as ellipsoidal and other such cross-sections, may be devised. Additionally, and still by way of example only, a multiplicity of spring elements may be employed compatible with like alterations in the structure of the converging walls to provide further dissemination of biasing forces along the slit.

I claim:

1. A cap for a container comprising (a) an annular upper member adapted to be positioned in the mouth of the container, said annular member defining a cavity open at the top and having a circular upper wall portion, the outer surface of which is adapted to provide a fluid tight seal against the inner surface of said container when said annular member is pressed into the mouth of said container;

(b) a downwardly extending lower member connected to said annular upper member and having a pair of lower member walls spaced from the inner surface of said container when said annular upper member is pressed into the mouth thereof, said lower member walls defining a normally closed slit seal at the bottom end of said lower member; and (c) a pair of flexible spring elements each located on opposite sides of said slit seal and connected to one said lower member wall, each spring element defining an abutment wall intersecting with one said lower member wall along at least two lines of intersection spaced from one another about the midpoint of said slit, each of said abutment walls having a portion aligned with said circular upper wall portion outer surface so as to abut the inner surface of said container when said annular member is pressed into the mouth thereof and each of said abutment walls together with one of said lower member walls, defining an interior volume adjacent the midpoint of said slit seal, each of said lower member walls flexing into a respective said interior volume when said slit seal opens due to the penetration thereof by an instrument.

2. The cap of claim 1 in which said annular upper member defines a receiving means within said cavity for receiving a removable secondary sealing cap near said open top.

3. The cap of claim 2 in which said receiving means is an annular groove in the inner surface of the circular wall portion of said annular upper member.

4. The cap of claim 1 in which each of the abutment walls is a surface parallel to the longitudinal axis of said annular upper member.

5. The cap of claim 4 in which said lower member walls converge toward said slit and said abutment walls are segments of cylinders each having the longitudinal axis thereof substantially parallel to the axis of said annular upper member and said container when said annular upper member is pressed into the mouth thereof.

6. The cap of claim 5 in which said annular upper member has a flange wall parallel to and spaced from said upper circular wall portion and a top wall connecting said flange wall to said upper circular wall portion wherein said flange wall is adapted to provide a fluid tight seal against the outer wall of said container when said upper annular member is pressed into the mouth of said container.

7. A combination of a container with a stopper positioned within the mouth of said container, said stopper comprising (a) a circumferential upper wall defining a first cavity open at the top thereof;

(b) an outer surface of said upper wall adapted to provide a liquid tight seal against the inner surface of said container;

(c) downwardly extending lower walls connected to said circumferential upper wall and spaced from the inner surface of said container, said lower walls defining normally closed slit seal at the bottom end of said stopper;

(d) a pair of flexible spring elements located on opposite sides of said slit seal and connected to one of said lower walls, each spring element defining an abutment wall intersecting with one said lower wall along at least two lines of intersection spaced from one another about the midpoint of said slit, each of said abutment walls having a portion abutting the inner surface of said container and, each of said abutment walls together with one said lower wall defining a second cavity adjacent the midpoint of said slit seal, each said lower wall flexing into a respective said second cavity when said slit seal opens due to the penetration of an instrument; and (e) a secondary cap positioned within said first cavity and locked to the circumferential wall in a fluid tight relationship, said secondary cup being made of a material capable of being penetrated by the sharp end of liquid-bearing instrument and the volume of said container beneath said stopper being evacuated to less than standard air pressure.

8. The cap of claim 7 in which said lower walls converge toward said slit and each said abutment wall is a segment of a cylinder.

9. The cap of claim 7 in which said stopper has a flange wall parallel to and spaced from said circumferential wall and a top wall connecting said flange wall to said circumferential wall wherein said flange wall provides a liquid tight seal against the outer wall of said container.

* * * * *